US011865425B2

(12) United States Patent
Kim et al.

(10) Patent No.: US 11,865,425 B2
(45) Date of Patent: Jan. 9, 2024

(54) INDICATOR ASSEMBLY FOR GOLF CLUB CAPABLE OF CHECKING SWING TRAJECTORY

(71) Applicants: Ji Hoon Kim, Suwon-si (KR); Dae Ho Kim, Suwon-si (KR)

(72) Inventors: Ji Hoon Kim, Suwon-si (KR); Dae Ho Kim, Suwon-si (KR)

( * ) Notice: Subject to any disclaimer, the term of this patent is extended or adjusted under 35 U.S.C. 154(b) by 0 days.

(21) Appl. No.: 18/015,802

(22) PCT Filed: Jun. 8, 2021

(86) PCT No.: PCT/KR2021/007127

§ 371 (c)(1),
(2) Date: Jan. 12, 2023

(87) PCT Pub. No.: WO2022/014865

PCT Pub. Date: Jan. 20, 2022

(65) Prior Publication Data

US 2023/0191224 A1 Jun. 22, 2023

(30) Foreign Application Priority Data

Jul. 14, 2020 (KR) ..... 10-2020-0086967

(51) Int. Cl.
*A63B 69/36* (2006.01)

(52) U.S. Cl.
CPC ..... *A63B 69/3617* (2013.01); *A63B 69/3605* (2020.08); *A63B 69/3632* (2013.01); *A63B 2220/05* (2013.01); *A63B 2220/807* (2013.01)

(58) Field of Classification Search
CPC ..... A63B 69/3617; A63B 69/3605; A63B 69/3632; A63B 2220/05; A63B 2220/807
USPC ..... 473/190, 219, 224, 225, 226, 237, 268, 473/279, 324, 329, 330
See application file for complete search history.

(56) References Cited

U.S. PATENT DOCUMENTS 2,152,381 A * 3/1939 Harpster ..... A63B 69/3623 D21/718
2,660,436 A * 11/1953 Grossman ..... A63B 69/3617 346/135.1
2,908,504 A * 10/1959 Pratt ..... A63B 69/3623 434/252
3,754,764 A * 8/1973 Manheck ..... A63B 69/0026 462/69

(Continued)

FOREIGN PATENT DOCUMENTS

JP 10-80510 A 3/1998
JP 2017-77406 A 4/2017

(Continued)

*Primary Examiner* — Nini F Legesse
(74) *Attorney, Agent, or Firm* — NSIP Law

(57) ABSTRACT

An indicator assembly for a golf club capable of checking a swing trajectory according to the present invention comprises an indicator which is attached to one side of the head of the golf club, has a sheet shape, has a plurality of marks spaced at intervals, and is made of a material that can be scratched by the blow of a golf ball. The indicator assembly for a golf club capable of checking a swing trajectory according to the present invention includes the marks on the indicator that can leave a scratch by colliding with the golf ball, thereby specifying the location of the scratch to determine the user's swing trajectory and the type of the formed pitch.

5 Claims, 10 Drawing Sheets

(56) References Cited

U.S. PATENT DOCUMENTS

| | | | | | |
|---|---|---|---|---|---|
| 5,597,361 | A * | 1/1997 | Hope | A63B 69/3617 | 473/237 |
| 5,779,556 | A * | 7/1998 | Cervantes | A63B 69/3617 | 473/237 |
| 5,830,077 | A * | 11/1998 | Yavitz | A63B 69/3635 | 473/378 |
| 6,312,344 | B1 * | 11/2001 | Smith | A63B 69/3635 | 473/237 |
| 9,539,485 | B1 * | 1/2017 | Snow | A63B 69/3632 | |
| 2005/0233820 | A1 * | 10/2005 | Matthews | A63B 69/3617 | 473/237 |
| 2008/0254907 | A1 * | 10/2008 | Swartz | G01L 5/0052 | 374/E11.018 |

FOREIGN PATENT DOCUMENTS

| | | | |
|---|---|---|---|
| KR | 20-0319802 | Y1 | 7/2003 |
| KR | 10-1962916 | B1 | 3/2019 |
| KR | 10-2172854 | B1 | 11/2020 |

* cited by examiner

| Brand | Model | Weight | Flex | Torque | length | Tip Size | Butt size | Kick Pt. | CPM |
|---|---|---|---|---|---|---|---|---|---|
| Mitsubishi | Kurokage T.P | 63 | R | 4.2 | 46 | 8.4 | 15.95 | LOW | 240 |
| Mitsubishi | Kurokage T.P | 63 | SR | 3.2 | 46 | 8.4 | 15.95 | MID/HIGH | 250 |
| Mitsubishi | Kurokage T.P | 63 | S | 2.2 | 46 | 8.4 | 15.95 | MID/HIGH | 260 |
| Fujikara | Air SPEEDER | 45 | R | 4.3 | 46 | 8.4 | 15.95 | MID | 230 |
| Fujikara | Air SPEEDER | 55 | SR | 3.2 | 46 | 8.4 | 15.95 | HIGH | 255 |
| Fujikara | Air SPEEDER | 55 | S | 3.2 | 46 | 8.4 | 15.95 | HIGH | 264 |

FIG. 11

INDICATOR ASSEMBLY FOR GOLF CLUB CAPABLE OF CHECKING SWING TRAJECTORY

CROSS REFERENCE TO RELATED APPLICATIONS

This application is a U.S. National Stage Application of International Application No. PCT/KR2021/007127, filed on Jun. 8, 2021 which claims the benefit under 35 USC 119(a) and 365(*b*) of Korean Patent Application No. 10-2020-0086967, filed on Jul. 14, 2020 in the Korean Intellectual Property Office, the entire disclosure of which is incorporated herein by reference for all purposes.

TECHNICAL FIELD

The present disclosure relates to an indicator assembly for a golf club able to determine a swing trajectory and, more particularly, to an indicator assembly for a golf club, wherein the swing trajectory and the swing style of a user may be determined by analyzing an impact point and the occurrence of a scratch using an indicator attached to the head of a golf club, and thus a golf club suitable to the swing habit of the user may be provided.

BACKGROUND ART

Golf is a sport in which winning and losing are determined by comparing the numbers of strokes players take by hitting stationary golf balls with golf clubs, i.e., a player who has hit balls with fewer strokes wins. Recently, golf has become a lifestyle sport that everyone may enjoy not only on a golf course but also in a golf range and in a simulation golf range.

Although golf is a simple game played by hitting golf balls with clubs by swinging the clubs, a correct posture and the use of a golf club suitable to each player are required in order to accurately send a golf ball to an intended position. When a swing is performed with an incorrect posture or an unsuitable golf club is used, it is difficult to send a golf ball to an intended position, and a scratch offset to one side may be formed on the head of the golf club.

FIG. 1 is a set of images illustrating scratches formed on known golf clubs.

Scratches are formed when golf clubs scrape the ground, an obstacle, or the like during a swing. As can be seen from FIG. 1, scratches are offset to one side according to swing trajectories and habits of users.

Such scratches shorten the lifespans of golf clubs and spoil the aesthetic appearance of golf clubs. Thus, existing prior art for analyzing swings has continuously been performed to prevent scratches by improving swing trajectories and habits of users through trials and errors. However, attempts at analyzing swing using scratches formed by actual user swings are insignificant.

As prior art, Korean Patent No. 10-0620873 (titled: "SYSTEM AND METHOD FOR ANALYZING GOLF SWING MOTIONS") was registered.

This prior art relates to a golf swing motion analysis method of extracting n number of image frames corresponding to four or more (hereinafter, referred to as "n number of") predetermined standard motions including address, back swing top, impact, and finish motions among image frames of golf swing motions recorded by an image capturing device to analyze the golf swing motions through comparison with the standard motions thereof. The golf swing motion analysis method includes: (a) extracting image frames corresponding to the address, back swing top, impact, and finish motions of the golf swing motion image frames recorded by the image capturing device; (b) dividing the entirety of swing motions into an address-back swing top range, a back swing top-impact range, and an impact-finish range; extracting (n−4) number of image frames of the remaining motions corresponding to the standard motions using a subinterval proportion table in which progress time ratios for predetermined motions of respective ranges divided in step (b); and (d) matching each of the n number of extracted image frames to an image of the corresponding standard motion.

Although the prior art discloses a method of analyzing swing motions by capturing and analyzing images of a user swinging a golf club, it is impossible to determine an impact point at which the ball is impacted on the head of the club by analyzing only a swing trajectory, a degree to which the user sliced a ball by analyzing a scratch, and the like. A function of proposing a suitable golf club to the user is not included.

Accordingly, there is emerging demand for the development of a novel and advanced indicator assembly for a golf club, by which a point at which a golf ball is impacted on the head of a golf club and the degree to which the golf ball is sliced may be determined, offset scratches on the club head may be analyzed and prevented, and a suitable golf club to the user may be recommended.

DISCLOSURE

Technical Problem

Accordingly, the present disclosure has been made keeping the above-described problems occurring in the related art in consideration, and a main objective of the present disclosure is to determine a swing trajectory and a swing habit of a user on the basis of a scratch formed on an indicator through collision with golf balls as a golf club is swung.

Another objective of the present disclosure is to provide a swing pad intended to form a scratch on an indicator attached to a sole portion, i.e., a bottom portion of a club head.

Another objective of the present disclosure is to provide a method of capturing an indicator having a scratch using a user terminal to analyze the swing trajectory of a user and thus improve the swing of the user.

An additional objective of the present disclosure is to provide a function of recommending the user a suitable golf club by transmitting information regarding the swing trajectory and the swing habit of the user analyzed by the user terminal to a store server.

Technical Solution

In order to realize at least one of the above objectives, according to the present disclosure, provided is an indicator assembly for a golf club. The indicator assembly may include an indicator having a sheet shape, attached to a portion of a head of a golf club, and formed of a material allowing a scratch to be formed thereon through collision with a golf ball. The indicator may include a plurality of markers spaced apart from each other at predetermined distances, whereby a swing trajectory is able to be determined.

The indicator assembly may include a swing pad configured to be seated on a surface of ground, wherein the swing pad includes a base and a plurality of protrusions upright from the base, the protrusions being spaced apart from each other at predetermined distances.

The indicator assembly may include a user terminal. The user terminal may include: a fundamental information input module by which fundamental information of a user, including an experience, a scoring average, a golf club type of the user, is input; an image capturing module capturing an image of the indicator using a camera; a scratch information generation module generating scratch information by analyzing whether or not a scratch is formed on the indicator and a position of the scratch on the indicator; and a user pattern generation module generating user pattern information by analyzing the at least one scratch information.

In addition, the indicator assembly may include a store server. The store server may include: a transmission module receiving the fundamental information and the user pattern information; and a recommendation information providing module recommending the user a specific golf club by analyzing the fundamental information and the user pattern information.

Advantageous Effects

The indicator assembly for a golf club able to determine a swing trajectory according to the present disclosure has the following effects.

1) Since the indicator able to form a scratch through collision with a golf ball includes the marker, it is possible to specify a position at which a scratch is formed, thereby determining the swing trajectory of a user and a flight type of a ball formed by the swing trajectory.

2) Since the swing pad intended to form a scratch on the indicator attached to the bottom portion, i.e., the sole, of the head is provided, a position at which a scratch is formed may be more clearly determined.

Scratch information and user pattern information may be generated by capturing an image of the indicator having a scratch using a user terminal, and thus swing guide information able to help the user to improve his/her swing may be generated and provided.

4) Information generated using the user terminal may be transmitted to a store server to recommend a user a golf club with which the user may improve his/her swing trajectories and habits.

DESCRIPTION OF DRAWINGS

FIG. 11 is a conceptual view illustrating an example of a shaft database of the store server according to the present disclosure.

BEST MODE

Figure 1:
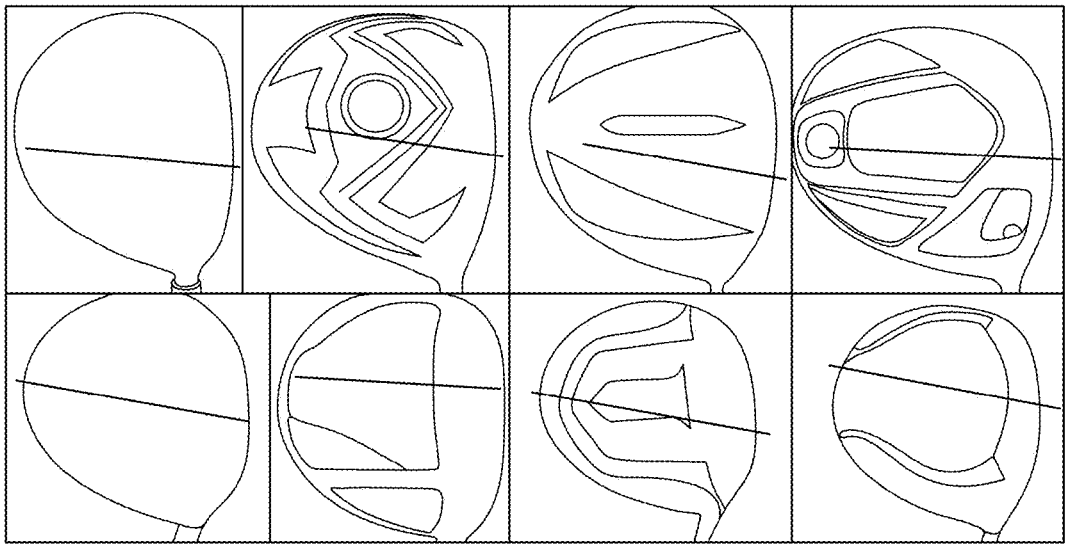
FIG. 1 is a set of images illustrating scratches formed on known golf clubs.

An indicator assembly for a golf club able to determine a swing trajectory according to the present disclosure includes an indicator having the shape of a sheet, attached to a portion of the head of a golf club, and formed of a material on which a scratch may be formed through collision with a golf ball. The indicator includes a plurality of markers spaced apart from each other at predetermined distances.

MODE FOR INVENTION

Hereinafter, example embodiments of the present disclosure will be described in detail with reference to the accompanying drawings. It should be understood that the accompanying drawings may not be drawn to scale, the same or like reference numerals may be used to refer to the same or like elements throughout the drawings.

Figure 2:
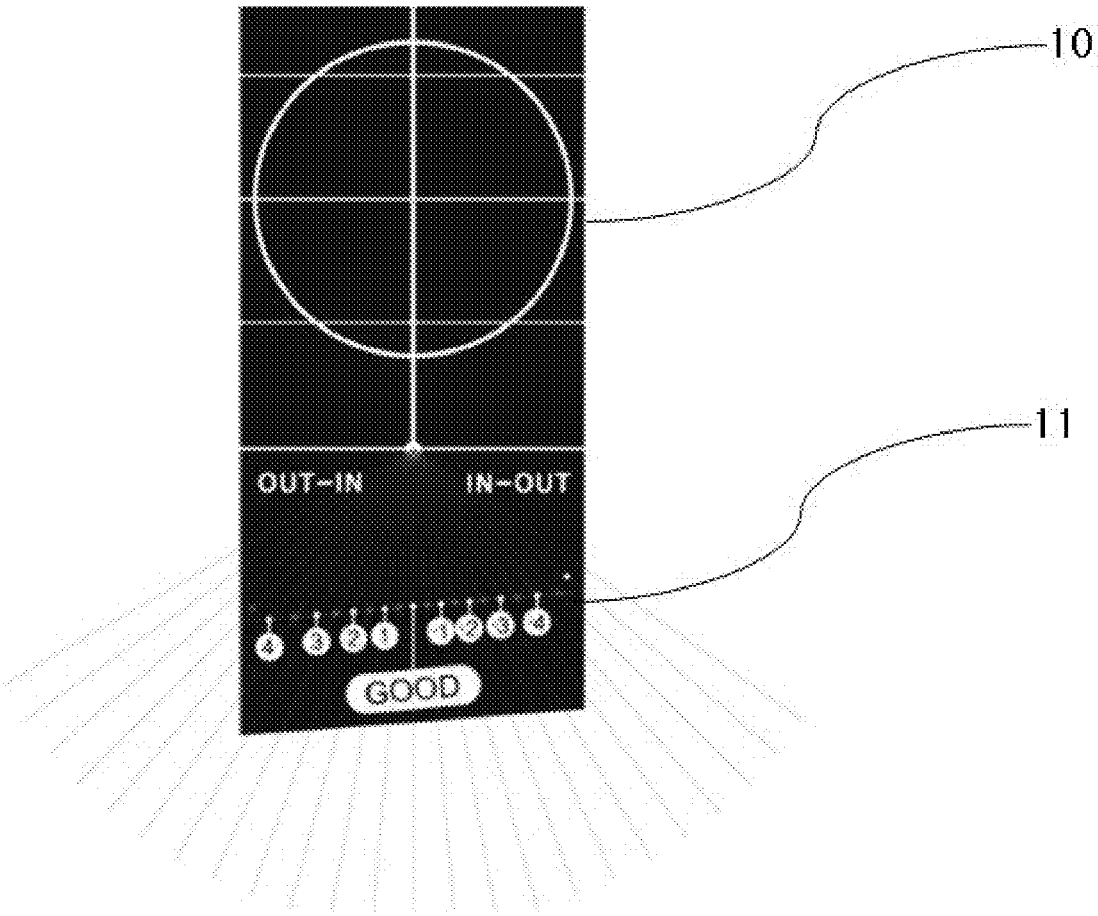
FIG. 2 is a conceptual view illustrating an embodiment of an indicator according to the present disclosure.
Figure 3:
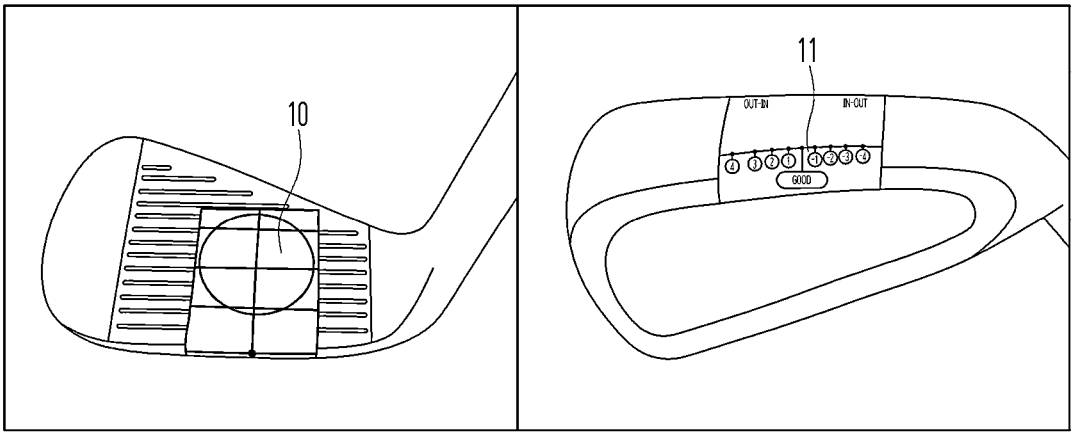
FIG. 3 is a conceptual view illustrating an embodiment in which the indicator according to the present disclosure is attached to a head.
Figure 4:
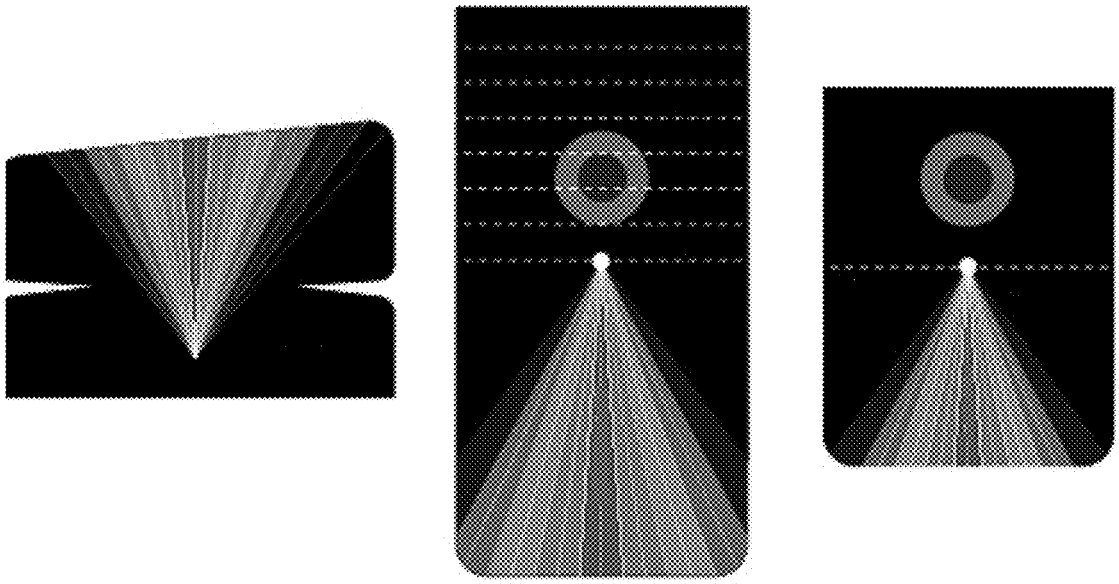
FIG. 4 is a conceptual view illustrating a variety of embodiments of the indicator and a mark according to the present disclosure.

FIG. 2 is a conceptual view illustrating an embodiment of an indicator according to the present disclosure, FIG. 3 is a conceptual view illustrating an embodiment in which the indicator according to the present disclosure is attached to a head, and FIG. 4 is a conceptual view illustrating a variety of embodiments of the indicator and a mark according to the present disclosure.

The indicator assembly for a golf club according to the present disclosure includes an indicator 10.

As can be seen from FIGS. 2 and 3, as fundamental characteristics, the indicator 10 has the shape of a thin rectangular sheet, and the thickness and the material of the indicator 10 are determined such that a portion of the indicator 10 may be peeled or stamped so as to form a scratch when the indicator 10 collides against a golf ball during swinging.

Specifically, the sheet-shaped indicator 10 may be fabricated such that the thickness thereof ranges from 0.5 mm to 2 mm in order to prevent a scratch due to a collision from being excessively formed (e.g., overlapping of scratches) or a case in which no scratch is formed.

In addition, the indicator 10 may be formed of a polyvinyl alcohol (PVA) sheet, synthetic paper, a chloroprene sheet, or the like. When a golf ball collides against the indicator 10, such a material is not easily torn while a scratch is formed on the material. Thus, only a collision portion of the material may be slightly peeled or stamped so as to be specified.

In addition, as illustrated in FIG. 3, the indicator 10 may be attached to the front side of the head, i.e., the face and the bottom portion (or the sole) of the head, which may be a portion hitting a golf ball. Here, the indicator 10 may be attached to both the face and the sole.

Furthermore, as can be seen from FIG. 2, one portion of the terminal of the indicator 10 is inclined so as to conform to the unique shape of the head, the width of which increases from one side to the other side of the sole connected to the shaft. Due to this configuration, a problem in that the indicator 10 attached the head becomes loose from the head may be prevented.

Here, the indicator 10 may include an adhesive layer on an attachment surface to be in contact with the face and the sole so as to be attached to the head. The adhesive layer may be formed of ethyl acrylate, poly dimethyl siloxane, or the like. The adhesive layer may be attached to the head by applying a small amount of pressure at room temperature and be detached from the head without leaving a residue on the head.

As illustrated in FIG. 2, the indicator 10 according to the present disclosure includes markers 11.

Specifically, the markers 11 are formed on a portion of the indicator 10 corresponding to the face that is a portion hitting a golf ball, but are not limited thereto. Rather, the markers 11 may be extended to a portion of the indicator 10 corresponding to the indicator, in addition to the portion of the indicator 10 corresponding to the face.

Here, the markers 11 may be formed on the portion expected to hit a golf ball (e.g., the face or the sole) in the shape of points, starts, circles, or the like. A plurality of markers 11 may be formed at predetermined distances according to a reference, for example, along a specific line.

In other words, the portion expected to hit a golf ball is the face but a portion of the head on which a scratch will be substantially formed through contact with the ground or an obstacle during swinging is the sole. Thus, the markers 11 according to the present disclosure may be formed not only on the portion of the indicator 10 corresponding to the sole, but also on the portion of the indicator 10 corresponding to the face that actually hits a golf ball.

In addition, the specific line means an index extending in the longitudinal direction or the width direction of the head.

In the present disclosure, the height of the head indicates the top-bottom direction (i.e., y-axis direction) of the head, the length of the head indicates the right-left direction (i.e., the x-axis direction) of the head, and the width of the head indicates the front-rear direction (i.e., the z-axis direction) of the head.

In addition, the indicator 10 may include a circle marked substantially on the central area of the portion of the face of the head to which the indicator 10 is attached. The circle is included in the central portion of the face, i.e., the portion hitting a golf ball when the golf ball is accurately impacted by the golf club. Thus, a degree to which the portion that hit the golf ball is offset from the center may be approximately determined on the basis of the circle.

Furthermore, in an edge portion with respect to the longitudinal direction of the head, the specific line may extend in an extension direction of an edge. In the present disclosure, this specific line will be referred to as a reference line.

In a corresponding manner, the markers 11 may be formed at predetermined distances in right and left directions (i.e., in the longitudinal direction of the head) with respect to the center of the reference line.

More particularly, the plurality of markers 11 may be formed at equal distances along the reference line, for example, according to FIGS. 2 to 10 or FIG. 5 with respect to a predetermined reference point. In this case, the reference line has the shape of an arc. That is, the markers 11 may be formed along a curved reference line. The reference line is not limited thereto, but may be a straight line connecting a start point and an endpoint of the arc. In this reference line in the shape of a straight line, the markers 11 may not be at equal distances. However, the differences between the distances are too faint to be visually recognized. Thus, when the markers 11 according to the present disclosure are at equal distances, the reference line on which the markers 11 may be based is not limited to a specific shape.

More particularly, the markers 11, the distances of which increase according to a predetermined rule as described above, may include serial numbers marked in right and left directions. For example, the serial numbers of the markers 11 may include, for example, 0 marked in the central portion of the indicator 10, as well as 1, 2, 3, and 4 in the left direction of the indicator 10 and −1, −2, −3, and −4 in the right direction in FIG. 2.

Here, the serial numbers do not mean scores according to high and low values, but are intended to estimate the distance of the scratch from the center of the indicator 10. To the number 0 in the central portion in which a scratch is formed when a golf ball is accurately hit, a word such as good, nice, or excellent may be added.

The function of the indicator 10 according to the present disclosure based on the above-described structure will be described as follows.

Figure 5:
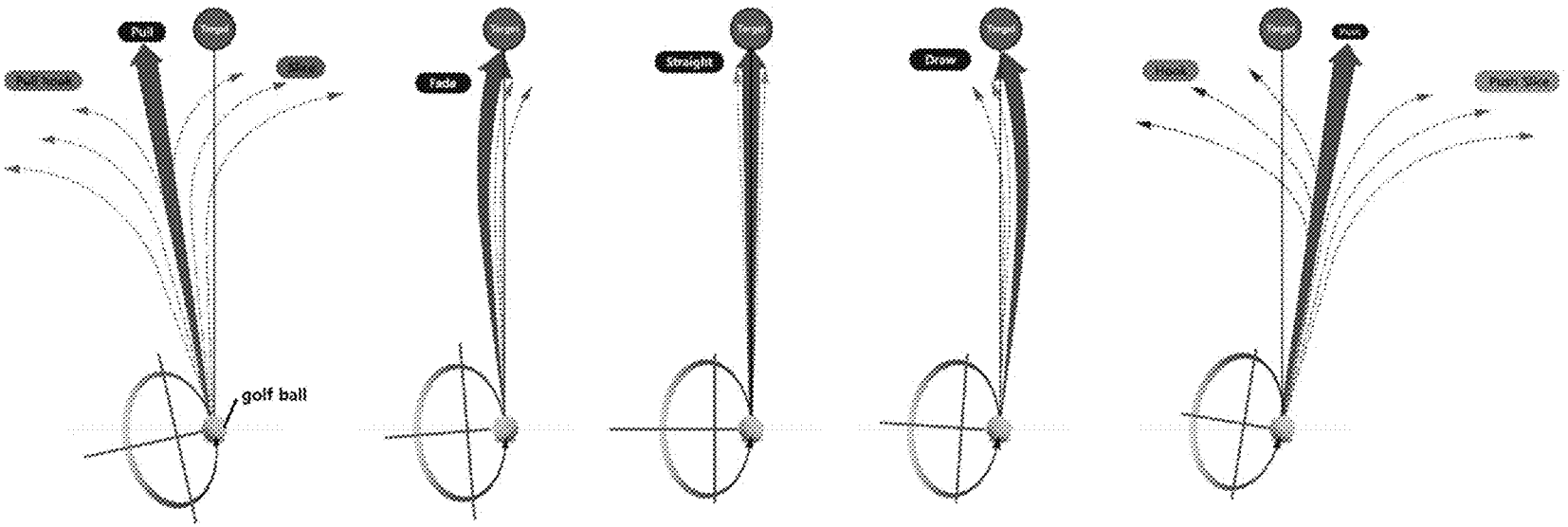
FIG. 5 is an example view illustrating directions of flight of golf balls according to swing trajectories.

FIG. 5 is an example view illustrating directions of flight of golf balls according to swing trajectories.

First, as can be seen from FIG. 5, (C) indicates a straight shot, and (A), (B), (D), and (E) indicate non-straight shots. When viewed in FIG. 5 for the sake of brevity, a case in which a golf ball deflects to the left from the target as in (A) and (B) will be referred to as left deflection, while a case in which a golf ball defects to the right from the target as in (D) and (E) will be referred to as right deflection. In a description with reference to FIG. 5, the indicator 10 will be referred to. The markers 11 of the indicator 10 will be described to be up, down, right, and left with respect to the direction of the indicator 10 illustrated in FIG. 2 above.

In addition, in FIG. 5, the golf ball is located at the right point of the circle. Here, when a user is assumed to be right handed, the left side of the body of the user is oriented in the front direction (i.e., the upward direction in FIG. 5) in which the golf ball moves, and the upper portion of the indicator 10 is oriented in the front direction in which the golf ball moves. With reference to this, the position of the scratch of the indicator 10 according to the golf ball trajectory will be described.

In (A) and (B) of FIG. 5, left deflection is illustrated. In this case, a scratch may be formed on a right portion of the indicator 10. In contrast, in (C) and (D) of FIG. 5, right deflection is illustrated. In this case, a scratch may be formed on a left portion of the indicator 10.

In addition, although the golf balls deflect left in both (A) and (B) of FIG. 5, the golf ball in (A) more deflects left than the golf ball in (B). The scratch formed on the indicator 10 in (A) is more offset to the right than the scratch formed on the indicator 10 in (B).

Accordingly, the user may acknowledge the right or left deflection of the golf ball as in (A) to (E) of FIG. 5. In addition, as the comparison in (A) and (B), the degrees of the left deflection and the degrees of right offset of the scratches may be compared. The markers 11 of the indicator 10 may be included, for example, as a plurality of points to provide a reference by which the degree of offset of a scratch may be approximately determined.

That is, the indicator 10 according to the present disclosure allows the user to visually and approximately determine the left/right defection of a golf ball and left/right offset of a scratch.

In addition, the markers 11 may converge to a specific position of the indicator 10 via the reference line. In this case, the ease of identification in determining the position and height of the scratch may be added.

For example, when the scratch is formed on the right end and the lower portion of the indicator 10, the trajectory of a ball is deflected to the left as in (A) of FIG. 5. In addition, it may be estimated that the driving distance of the golf ball is reduced and the ball has topspin (i.e., rotation imparted to the golf ball in the same direction as the flight of the golf ball) since the golf ball is hit with the lower portion of the face.

In other words, in a case in which the markers 11 converge via the reference line, a reference by which the position and the height of scratch may be identified is additionally provided, compared to a case in which only the plurality of markers 11 able to provide only an approximate reference for determination are provided. Thus, the offset of the scratch may be more intuitively determined.

Furthermore, when the markers 11 displayed via the reference line are serial numbers, the numbers may provide concreteness to determination of the scratch formed on the indicator 10.

For example, when the trajectory of the golf ball is deflected left as in (B) of FIG. 5, the scratch may be formed on "−2" in the serial numbers. When the trajectory of the golf ball is further deflected left as in (A) of FIG. 5, the scratch may be formed at position adjacent to "−3" or "−4", which is a serial number offset to the right.

That is, the user may more specifically determine the position at which the scratch is formed from the markers 11 comprised of the serial numbers.

In summary, since the indicator 10 according to the present disclosure includes the markers 11, the position at which the scratch is formed may be approximately determined. Since the markers 11 converge via the reference line, the position at which the scratch is formed may be intuitively determined. Since the markers are the serial numbers, the position at which the scratch is formed may be more specifically determined.

Figure 6:
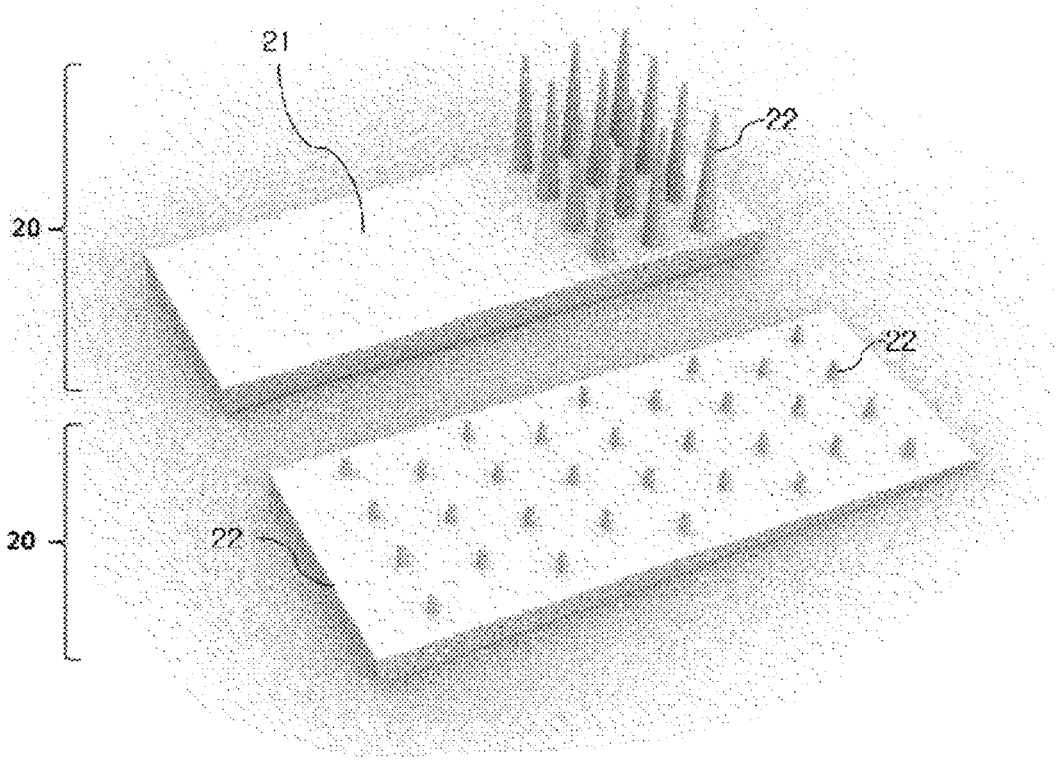
FIG. 6 is a conceptual view illustrating an embodiment of a swing pad according to the present disclosure.

FIG. 6 is a conceptual view illustrating an embodiment of a swing pad according to the present disclosure.

According to another embodiment of the present disclosure, the assembly for a golf club includes a swing pad 20.

The swing pad 20 is configured to be seated on the surface, for example, of the ground. The swing pad 20 may include a base 21 and a plurality of protrusions 22 on the top surface of the base 21, i.e., the surface facing upward when seated on the ground surface.

Here, the base 21 has the shape of a flat plate. The bottom surface of the base 21, i.e., the surface facing the ground when seated on the ground, is flat, so that the base 21 is stably seated on the ground. The top surface may be flat like the bottom surface, or may be formed oblique. In this manner, a variety of golf course environments may be reflected.

In addition, the base 21 may be formed of butadiene rubber, styrene butadiene rubber, or the like that has a feeling of weight and is elastic. The base 21 may be easily seated on the ground surface while enduring impacts due to elasticity.

A plurality of concave and convex structures may be additionally provided on a lower side surface of the base 21 to increase the coefficient of friction so as to prevent the base 21 from slipping on the ground surface. The base 21 may also have a through-hole into which a tee may be driven.

In addition, the plurality of protrusions 22 are upright from the top surface of the base 21 and spaced apart from each other at predetermined distances. The thickness of each of the protrusions 22 gradually decreases in a direction away from the base 21. The protrusions 22 may have a length of 2 cm to 15 cm so as to realize a variety of lengths of grass of golf courses.

In addition, the protrusions 22 may be formed of butadiene rubber, hypalon rubber, or the like. The protrusions 22 may be formed of the same material as or a different material from the base 21. The protrusions 22 may be fabricated as an integrated portion of the base 21 or to be detachably attached to the base 21.

The protrusions 22 are intended to form a scratch on the indicator 10 when a golf club is swung. A swing trajectory of a user may be more specifically analyzed from an elongated scratch formed through contact with at least one of the protrusions 22.

Returning to FIG. 5, for example, when the swing trajectory is directed to the front, a golf ball is directed toward a target, and the scratch formed by the protrusions 22 is also directed to the front. In the fifth example in which the swing trajectory is offset outward, the golf ball is directed outward, i.e., to the right. In this case, the scratch formed by the protrusions 22 may also deflect outward like the direction of flight of the golf ball. That is, the swing trajectory of the user may be specified on the basis of the scratch formed by the protrusions 22.

The swing pad 20 may be specialized to intentionally form a scratch on a driver on which no scratch may be formed when a swing is normal, since a golf ball is placed on a tee for an initial drive. However, the present disclosure is not limited thereto, and the swing pad 20 may also be applied to a putter or the like.

In summary, the swing pad 20 according to the present disclosure includes the base 21 capable of being seated on the ground and the plurality of protrusions 22 provided on the top surface of the base 21, and is intended to form a scratch on the indicator 10. The scratch formed in this manner corresponds to the swing trajectory, so that the swing habit of the user may be analyzed on the basis of the scratch.

Figure 7:
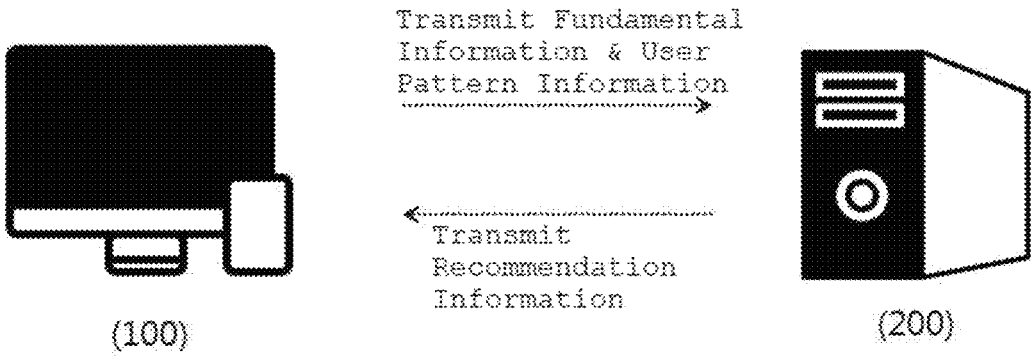
FIG. 7 is a conceptual view illustrating the relationship between a user terminal and a store server according to the present disclosure.
Figure 8:
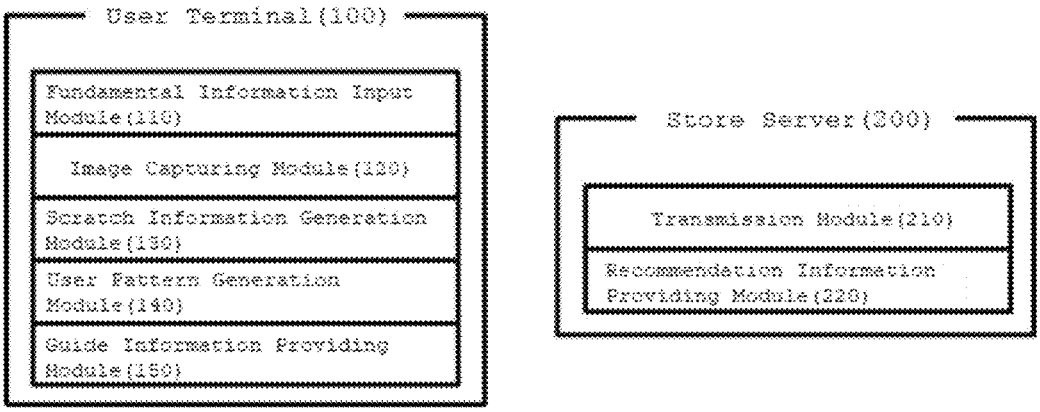
FIG. 8 is a block diagram illustrating a configuration of the user terminal and the store server according to the present disclosure.

FIG. 7 is a conceptual view illustrating the relationship between a user terminal and a store server according to the present disclosure, and FIG. 8 is a block diagram illustrating a configuration of the user terminal and the store server according to the present disclosure.

According to another embodiment of the present disclosure, the assembly for a golf club includes a user terminal 100.

Here, the user terminal 100 includes a fundamental information input module 110, an image capturing module 120, a scratch information generation module 130, and a user pattern generation module 140. The user terminal 100 may be a known user-portable device, such as a smartphone, a personal digital assistant (PDA), or a notebook computer, including an input means, an image capturing means, a display, a memory, and a communication means.

Here, the fundamental information input module 110 is a module by which fundamental information of the user, i.e., information regarding the name, body sizes, golf-related experience, scoring average, type of a golf club used, glove size, and the like of the user, is input. The fundamental information input module 110 may receive the fundamental information through an input means, such as a keypad or a keyboard, provided on the user terminal 100.

For example, fundamental information of user A input by the fundamental information input module 110 may include "name: A, gender: male, age: 42, height: 178 cm, glove size: 22, experience: 6 years, scoring average: 95, club type: 00 available from XX, and right-handed."

The fundamental information input module 110 receives and stores fundamental personal information and golf experience of the user as the fundamental information. The fundamental information input module 110 serves to store the fundamental information in a user database, for example, included in a storage means, such as a memory, of the user terminal 100.

In addition, the image capturing module 120 captures an image of the scratched indicator 10 using a known image capturing means, such as a camera, provided in the user terminal 100. An image captured by the image capturing module 120 may be stored in the user database.

The image capturing module 120 captures an image of the indicator 10 scratched during swinging of a golf club by the user to provide a basis by which the scratch formed on the indicator 10 may be analyzed.

In addition, the scratch information generation module 130 analyzes the image of the indicator 10 captured by the image capturing module 120. The scratch information generation module 130 includes a known image analysis tool and algorithm. The scratch information generation module 130 may generate information by analyzing the occurrence and position of a scratch and store the information in the user database.

For example, the scratch information may be generated in the form of "occurrence of scratch: 0, position: −3" or "occurrence of scratch: 0, position: 2." Here, the position means the position of the scratch according to the serial numbers of the markers 11. Furthermore, for example, when the scratch is located between 2 and 3 of the serial numbers, a more accurate position, such as 2.6, of the scratch may be determined using the known image analysis tool.

In addition, the user pattern generation module 140 generates user pattern information by analyzing the scratch information. The user pattern information may be generated by analyzing the scratch information of at least one scratch using a processing device, such as a central processing device (CPU), of the user terminal 100.

Here, the user pattern information means information regarding the swing pattern, i.e., the swing trajectory, and the swing habit of the user determined on the basis of the result of analysis of a degree by which the scratch is offset from the center of the indicator 10. For example, when the markers 11 are provided along the reference line in FIG. 5, the user pattern information may be generated in the form of "swing offset: inward, swing trajectory: −11°, and estimated flight type: pull" from the illustration of the scratch information "occurrence of scratch: 0, position: −3" or "occurrence of scratch: 0, position: 2."

In addition, the illustration of the user pattern information may be an illustration of the user pattern information generated with respect to the swing trajectories and the flight directions illustrated in (1) and (2) of FIG. 5.

In other words, the user pattern generation module 140 provides a function of generating the user pattern information and storing the user pattern information in the user database by analyzing a degree by which and a direction in which the swing pattern, i.e., the swing trajectory, of the user is offset from the scratch information.

In summary, the user terminal 100 according to the present disclosure includes the fundamental information input module 110, the image capturing module 120, the scratch information generation module, the user pattern generation module, and the user database. The user terminal 100 is characterized by receiving the fundamental personal information and golf skills of the user, analyzing scratches on the indicator 10 as the result of hitting a golf ball by an actual swing, and storing the analyzed information, thereby converting the swing trajectories of the user into numbers and information.

Figure 9:
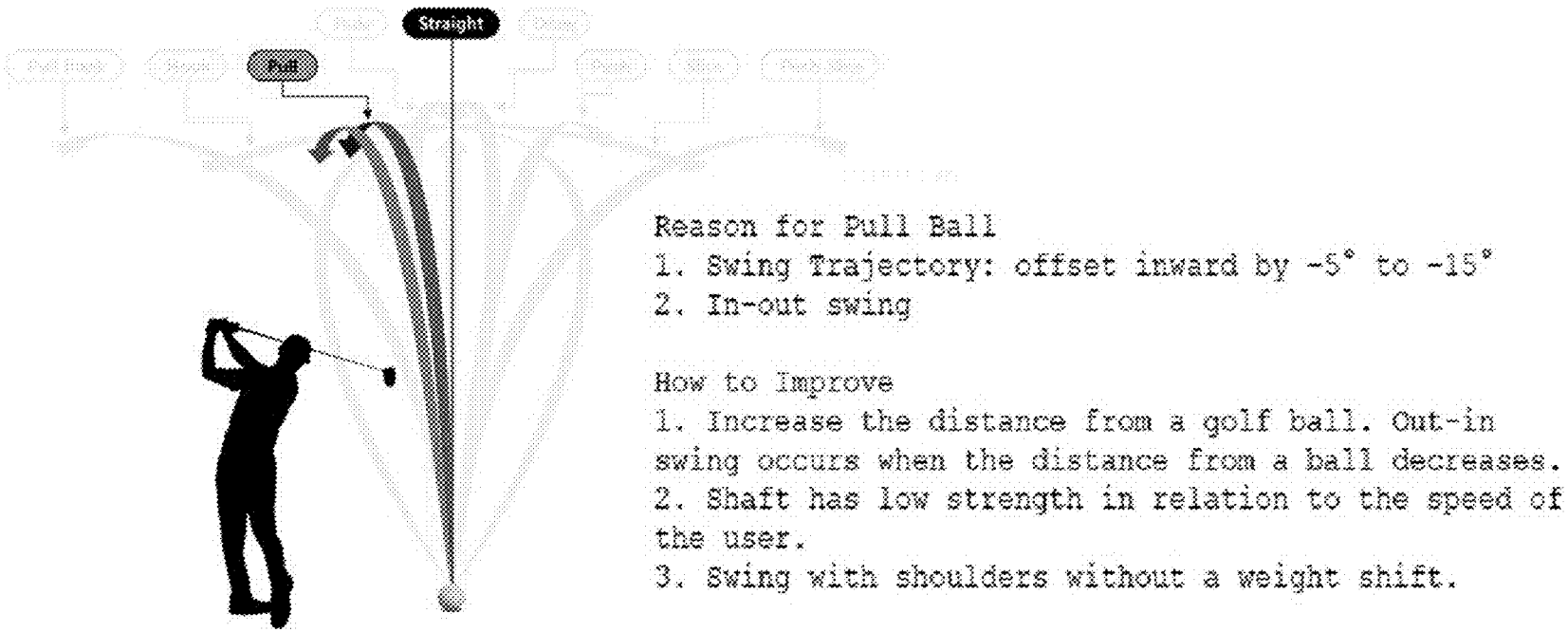
FIGS. 9 and 10 are conceptual views illustrating an embodiment of swing guide information provided by an information providing module according to the present disclosure.
Figure 10:
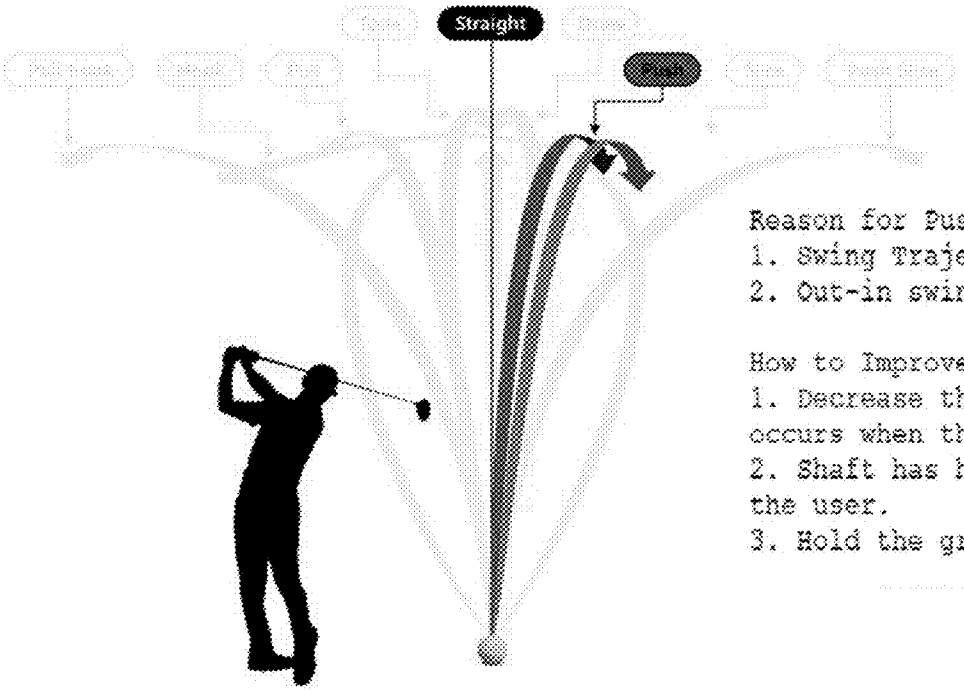

FIGS. 9 and 10 are conceptual views illustrating an embodiment of swing guide information provided by an information providing module according to the present disclosure.

The user terminal 100 further includes a guide information providing module 150.

The guide information providing module 150 provides a user with the swing guide information corresponding to user pattern information obtained by analyzing the swing habit of the user. The guide information providing module 150 may provide the user with the swing guide information using a known display device provided in the user terminal 100.

Here, as can be seen from FIGS. 9 and 10, the swing guide information includes a reason for an estimated flight included in the user pattern information and a swing improvement method. The swing guide information may match the corresponding user pattern information through a unique algorithm included in the guide information providing module 150.

For example, the swing guide information corresponding to at least one including the swing trajectory, i.e., "swing trajectory: −11°," of the information regarding the swing offset, the swing trajectory, and the estimated flight type in the illustration of the user pattern information in which the swing trajectory is −11° may be provided to the user.

In addition, the swing guide information including the fundamental information, the scratch information, and the user pattern information stored in the user database may be provided to the user. On the basis of the swing guide information, a store server 200 to be described later may identify a user to which the swing guide information relates.

the swing guide information provided to the user with reference to FIG. 9 may be, for example, "swing offset: inward, swing trajectory: −11°, estimated flight type: pull, reason for pull: occurring during swinging from out to in at a degree of −5° to −15°, and how to improve: increase distance from a golf ball (since the out-in swing occurs with increase in the distance from a ball) and swing with shoulders without weight shift."

In addition, as an illustration with reference to FIG. 10, the swing guide information may be, for example, "swing offset: outward, swing trajectory: 9°, estimated flight type: push, reason for push: occurring during swinging from in to out at a degree of 5° to 15°, and how to improve: decrease distance from a golf ball (since the in-out swing occurs with decreases in the distance from a ball) and hold the grip by reducing the distance between hands."

The swing guide information serves to remind the user of problems in the swing by providing the result of scratches and non-straight swing trajectories and allow the user to correct his/her swing habit by providing the swing improvement method.

Figure 12:
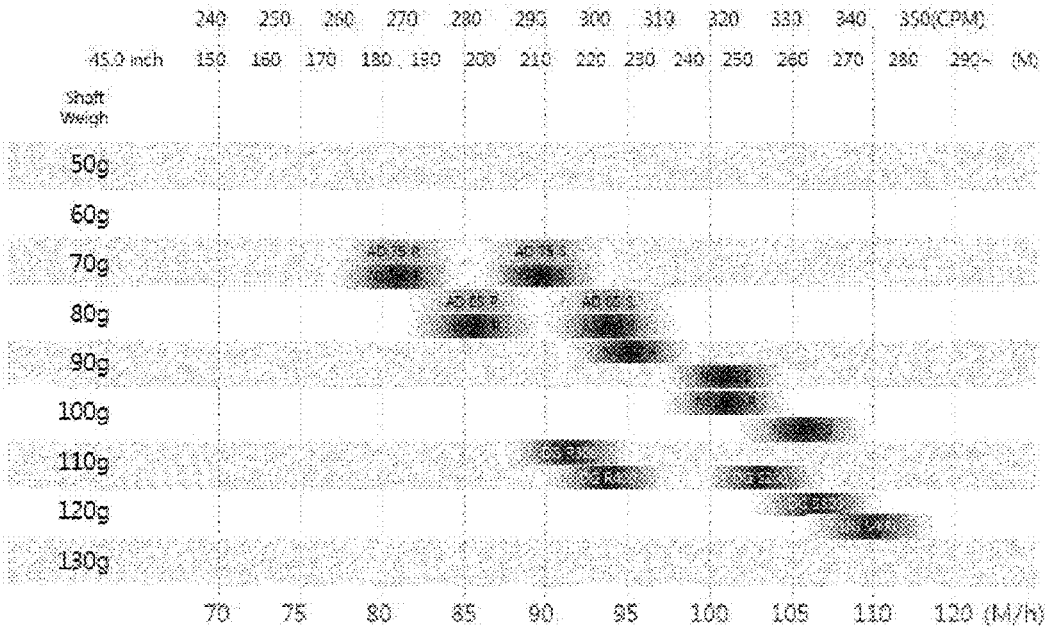
FIG. 12 is a conceptual view illustrating an analysis method of a recommendation information providing module according to the present disclosure.

FIG. 11 is a conceptual view illustrating an example of a shaft database of the store server according to the present disclosure, and FIG. 12 is a conceptual view illustrating an analysis method of a recommendation information providing module according to the present disclosure.

In addition, the assembly for a golf club according to the present disclosure includes the store server 200.

The store server 200 includes a transmission module 210 and a recommendation information providing module 220. A program, i.e., software, executable by a CPU on a hardware basis including the CPU, a storage means such as a memory and a hard disk drive, and a wired communication means and/or a wireless communication means such as a Bluetooth device may be installed in the store server 200, and the store server 200 may execute the software.

Here, the transmission module 210 receives the fundamental information in the user terminal 100 and the user pattern information transmitted through the wired/wireless communication means. The transmission module 210 may store the fundamental information and the user pattern information transmitted in a store database included in the storage means of the store server 200.

In addition, the store server 200 may include a plurality of databases, including not only the store database but also a shaft database, a head database, and the like. The specification of golf clubs possessed by the store may be stored in the store server 200.

For example, as can be seen from FIG. 11, the shaft database may include brand names, models, lengths, weights, and the like of shafts.

In addition, the recommendation information providing module 220 recommends the user a golf club with which the user may improve his/her swing habit by analyzing the fundamental information and the user pattern information transmitted. The recommendation information providing module 220 may select and recommend a golf club suitable to the user by analyzing the fundamental information, the user pattern information, and information in the database of the store server 200 using the CPU of the store server 200.

For example, as can be seen from FIG. 12, the recommendation information providing module 220 may select and recommend a golf club according to the weight, length, and cycles per minute (CPM: an index obtained by quantifying the elasticity of the shaft) of the shaft. In FIG. 12, AD 75R, NS 850S, and the like are brand names of golf clubs.

When the shaft has high strength (when the weight is heavy, the length is long, and the CPM is high) in relation to the swing of the user, a hook or a pull in which a golf ball curves inward may occur. When the shaft has low strength in relation to the swing of the user, a push or a slice in which a golf ball curves outward may occur.

Here, recommendation information, i.e., information regarding the golf club that the recommendation information providing module 220 recommends, may be transmitted to the user terminal 100 through the wired/wireless communication means and provided to a manager (e.g., a store employee) of the store server 200 through a display of the store server 200.

For example, in the case of the illustration of the fundamental information and the user pattern information described above, i.e., "name: A, gender: male, age: 42, height: 178 cm, glove size: 22, experience: 6 years, scoring average: 95, club type: 00 available from XX, and right-handed" and "swing offset: inward, swing trajectory: −11°, and estimated flight type: pull," the pull occurs since currently-used 00 shaft available from XX company has high strength in relation to the swing of user A. Thus, the recommendation information providing module 220 may recommend a golf club having a shaft having relatively low strength (i.e., a golf club located on the top left in the view of FIG. 12 among golf clubs illustrated in FIG. 12).

That is, the recommendation information including brand names, such as AD 75R and NS 850S, may be transmitted to the user terminal 100 of the user A and the manager of the store server 200.

In summary, the store server 200 according to the present disclosure is characterized by recommending the user a golf club suitable to the user by analyzing the fundamental information of the user, the user pattern information generated on the basis of the scratch formed when the user actually hits a golf ball, and the plurality of databases provided in the store server 200. Accordingly, the user may improve the swing and correct his/her swing habit.

According to another embodiment, a sealing layer may be applied to the surface of the indicator 10 according to the present disclosure.

The sealing layer contains an epoxy resin. After applied to the surface of the indicator 10, a sealing process of pressing the sealing layer in a weight condition of 80 mN to 120 mN in a temperature of 150° C. to 200° C. may be performed.

The sealing layer may impart a suitable level of tensile strength to the surface of the indicator 10. Thus, the indicator 10 may have suitable levels of strength and adhesiveness so that a small amount of the indicator 10 may be peeled or abraded without being torn by a swing. The thickness of the sealing-processed sealing layer may range from 10 μm to 100 μm.

As set forth above, the configurations and functions of the indicator assembly for a golf club able to determine a swing trajectory according to the present disclosure have been described with reference to the drawings. It should be understood, however, that the foregoing descriptions are illustrative only, and the technical idea of the present disclosure is not limited to the foregoing descriptions or the accompanying drawings. Those having ordinary knowledge in the art will appreciate that various modifications and changes in forms are possible without departing from technical idea of the present disclosure.

INDUSTRIAL APPLICABILITY

The indicator assembly for a golf club according to the present disclosure has mass productivity, and thus is regarded as having industrial applicability.

The invention claimed is:

1. An indicator assembly for a golf club, the indicator assembly comprising an indicator having a sheet shape, attached to a portion of a head of a golf club, and formed of a material allowing a scratch to be formed thereon through collision with a golf ball, wherein the indicator comprises a plurality of markers spaced apart from each other at predetermined distances, whereby a swing trajectory is able to be determined, wherein the indicator comprises a reference line extending in a direction of extension of an edge in an edge portion with respect to a longitudinal direction of the head, wherein the plurality of markers are provided at predetermined distances in right and left directions with respect to the center of the reference line, and wherein the markers comprise serial numbers sequentially marked in the right and left directions with respect to the center of the reference line.

2. The indicator assembly according to claim 1, comprising a swing pad configured to be seated on a surface of ground, wherein the swing pad comprises a base and a plurality of protrusions upright from the base, the protrusions being spaced apart from each other at predetermined distances.

3. The indicator assembly according to claim 1, comprising a user terminal, wherein the user terminal comprises:

a fundamental information input module by which fundamental information of a user, including an experience, a scoring average, a golf club type of the user, is input;

an image capturing module capturing an image of the indicator using a camera;

a scratch information generation module generating scratch information by analyzing whether or not a scratch is formed on the indicator and a position of the scratch on the indicator; and a user pattern generation module generating user pattern information by analyzing the at least one scratch information.

4. The indicator assembly according to claim 3, wherein the user terminal further comprises a guide information providing module providing the user with swing guide information according to the user pattern information.

5. The indicator assembly according to claim 3, comprising a store server, wherein the store server comprises:

a transmission module receiving the fundamental information and the user pattern information; and a recommendation information providing module recommending the user a specific golf club by analyzing the fundamental information and the user pattern information.

* * * * *